US008371831B2

(12) United States Patent
Marioni

(10) Patent No.: US 8,371,831 B2
(45) Date of Patent: Feb. 12, 2013

(54) CENTRIFUGAL DISCHARGE PUMP WITH BLADED IMPELLER FOR DISHWASHERS AND SIMILAR ELECTRIC HOUSEHOLD APPLIANCES

(75) Inventor: Elio Marioni, Dueville (IT)

(73) Assignee: Askoll Holding S.r.l. (IT)

( * ) Notice: Subject to any disclaimer, the term of this patent is extended or adjusted under 35 U.S.C. 154(b) by 381 days.

(21) Appl. No.: 12/714,073

(22) Filed: Feb. 26, 2010

(65) Prior Publication Data

US 2010/0232990 A1 Sep. 16, 2010

(30) Foreign Application Priority Data

Mar. 11, 2009 (EP) ..... 09425099

(51) Int. Cl.
*F04B 35/04* (2006.01)

(52) U.S. Cl. ..... 417/423.1

(58) Field of Classification Search ..... 417/423.1; 416/180, 182, 185, 231 B, 231 R, 243; 415/121.1
See application file for complete search history.

(56) References Cited

U.S. PATENT DOCUMENTS

| | | | | |
|---|---|---|---|---|
| 1,864,834 | A * | 6/1932 | Klosson | 416/185 |
| 3,261,297 | A | 7/1966 | Daniel | |
| 4,556,364 | A * | 12/1985 | Barker | 415/172.1 |
| 4,904,159 | A | 2/1990 | Wickoren | |
| 5,104,541 | A | 4/1992 | Daniel | |
| 5,176,509 | A * | 1/1993 | Schmider et al. | 417/423.7 |
| 5,180,280 | A * | 1/1993 | Honda | 415/206 |
| 5,554,004 | A * | 9/1996 | Stewart | 416/185 |
| 6,564,595 | B2 * | 5/2003 | Junk et al. | 68/208 |
| 6,565,321 | B1 | 5/2003 | Illingworth et al. | |
| 8,025,479 | B2 * | 9/2011 | Scott | 415/206 |
| 2002/0182078 | A1 * | 12/2002 | Reinfeld et al. | 416/185 |
| 2003/0012642 | A1 * | 1/2003 | Soja | 415/128 |
| 2007/0196211 | A1 * | 8/2007 | Marioni | 416/175 |
| 2008/0041419 | A1 * | 2/2008 | Gaus | 134/10 |
| 2008/0219847 | A1 * | 9/2008 | Guzorek | 416/185 |
| 2009/0324402 | A1 * | 12/2009 | Grimm et al. | 415/203 |

FOREIGN PATENT DOCUMENTS

| | | | |
|---|---|---|---|
| WO | 2006/133577 | A1 | 12/2006 |
| WO | WO 2006133577 | A1 * | 12/2006 |

* cited by examiner

*Primary Examiner* — Devon Kramer
*Assistant Examiner* — Christopher Maxey
(74) *Attorney, Agent, or Firm* — Akerman Senterfitt

(57) ABSTRACT

A centrifugal discharge pump (1) for electric household appliances, of unusual efficiency, having: a working chamber which has an intake opening and a delivery opening; an open impeller (10) arranged inside the working chamber and rotatable about a main axis (x) and a motor (5) designed to drive the impeller (10) by means of a transmission shaft (6). The impeller (10) has a planar support element (11) integral with the transmission shaft (6), and a plurality of blades (12) projecting from the support element (11); a free space (13) is provided between the blades (12) in order to allow the removal of foreign solids present in the discharge stream.

9 Claims, 3 Drawing Sheets

CENTRIFUGAL DISCHARGE PUMP WITH BLADED IMPELLER FOR DISHWASHERS AND SIMILAR ELECTRIC HOUSEHOLD APPLIANCES

FIELD OF THE INVENTION

The present invention relates to a centrifugal discharge pump, with a bladed impeller, for electric household appliances. In particular, such a centrifugal pump is particularly suitable for use in dishwashers, although its use in laundry washing machines or other washing machines comprising a water discharge pump is not excluded.

BACKGROUND OF THE INVENTION

Centrifugal pumps of the above-mentioned type are usually present in the hitherto commercially available dishwashers.

They are designed to allow drainage of the dirty water used in the washing cycles of the electric household appliance into a waste water collection network.

For this purpose, such pumps use a bladed impeller driven by a small-size electric motor; the rotary motion of the impeller thus moves a stream of dirty water coming from an intake channel arranged along the axis of rotation of the part towards a delivery channel which is radial and tangential thereto.

However, when designing the impeller, it is necessary to take account of the specific function of the pump of which it forms part. This is because discharge pumps, unlike water recirculation pumps, are located downstream of a relatively coarse filter and the stream of water passing through them may become contaminated with small-size solids capable of stopping the device from functioning. Possible contaminants may consist of food residues, objects mistakenly introduced into the machine, such as toothpicks, or also suspensions originating from chemical interactions between the detergent and fatty substances present on the dishes.

In order to allow easy removal of the above-mentioned solids, a recessed impeller—i.e. an impeller whose blades do not extend sufficiently far to achieve a close clearance with the front wall of the working chamber—with straight blades is used. There are usually four such blades which are arranged at right angles to each other and extend radially from a central shaft connected to the motor.

The above-described geometry significantly reduces the risk of a pump blockage due to any foreign solids, since the latter have plenty of space to pass through, this being defined both by the interspace between impeller and front wall and by the volume present between adjacent blades.

While the discharge pumps according to the prior art are advantageous in various respects and are substantially fit for the purpose, they do have one major drawback which hitherto has not been overcome.

While, on the one hand, the above-mentioned geometry of the impeller does indeed ensure trouble-free operation even when solids are present in the discharge liquid, on the other hand it results in a level of hydraulic efficiency of the pump which is low compared to that which would be achieved if a close-clearance impeller with curved directional blades were to be used.

The limited hydraulic efficiency results in the need to use relatively large and powerful electric motors, resulting in greater wear of active materials such as copper and a consequent increasing in the cost of the discharge pump.

The technical problem underlying the present invention is consequently that of devising a discharge pump which allows removal, without any risk of blockage or jamming, of any solids which may contaminate the discharge water, but without this feature limiting the hydraulic efficiency of the pump itself.

DISCLOSURE OF THE INVENTION

The above-mentioned technical problem is solved by a centrifugal discharge pump for electric household appliances, comprising: a working chamber which has an intake opening and a delivery opening; motor means designed to drive an impeller by means of a transmission shaft arranged along a main axis; and an impeller arranged inside the working chamber and rotatable about the aforementioned main axis so as to move a discharge stream of the electric household appliance, coming from the intake opening through the delivery opening, said impeller being open and comprising: a support element arranged in a plane perpendicular to the main axis and integral with the transmission shaft; and a plurality of blades projecting from said support element; said impeller having, between said blades, along the main axis, a free space of predefined volume for allowing removal through the centrifugal pump of foreign solids present in the discharge stream.

In other words, while in the prior art the transmission shaft occupies the central part of the impeller and the blades are associated with it, in the invention the shaft is interrupted in the region of the support element, thus allowing the presence of the free space in the central part of the impeller; the blades are provided directly above the support element.

The free space provided between the blades, where the transmission shaft would normally extend, thus allows easy removal of the solids without limiting in any way the geometry of the blades themselves.

Said blades may therefore extend projecting from the support element so as to achieve a close clearance with a front inner surface of the working chamber, with a consequent advantageous improvement in the hydraulic efficiency of the machine.

Furthermore, said blades may be curved blades, specifically designed to convey the fluid in a predefined direction of rotation; for example, the blades may be of the type with a convex surface which faces forwards relative to the direction of rotation of the impeller. The curvature of the blades also helps improve the hydraulic efficiency of the machine; it may be synergically combined with the close-clearance extension or the impeller may be of the type with curved blades, but nevertheless recessed.

Since the directional blades define a preferential direction of rotation of the impeller, they may be associated with a high-efficiency spiral volute, thus further improving the hydraulic efficiency discussed above.

The aforementioned support element may advantageously be a disc having an axis coinciding with the previously defined main axis. In this case, the blades may extend along said disc from one peripheral edge to a minimum radius from the main axis, so as not to obstruct the free space in the central part of the impeller.

In one particular advantageous embodiment, the blades may be composed of: a first portion, which extends from the peripheral edge of the disc to an intermediate radius, with a constant height relative to the disc surface; and a second portion, which extends from the intermediate radius to the minimum radius, with a diminishing height connecting the first portion to the disc surface.

In particular, the blades may be two in number and directed so that the free space passes diametrically across said disc, without intersecting either one of said blades.

In fact, advantageously, the impeller may be designed so that the free space passes diametrically across the disc so as to form a corridor which has a width equal to at least twice the minimum radius, said corridor not intersecting either one of the blades. In this way, it is possible to ensure the presence of a free corridor twice the size of the minimum radius, which crosses the impeller, allowing removal of the solids through it.

In a manner consistent therewith, the intake opening and the delivery opening may also have a radius at least twice the minimum radius; moreover, the intake opening may open out in a front inner surface of the working chamber along the main axis and the delivery opening may open out in a lateral inner surface of the working chamber.

Thus, a solid object with a size smaller than twice the minimum radius entering into the working chamber through the intake opening is situated directly inside said corridor, from where it is able to reach the delivery opening without encountering obstacles.

It should be noted that the minimum radius may advantageously be equal to or greater than at least one third of the radius of the impeller disc and equal to or less than half thereof.

The motor means may comprise a synchronous electric motor which can be controlled by the electronics of a separate washing pump of an electric household appliance with which the centrifugal pump is associated.

This results in the advantage of electronic control of the machine and avoids the costs of a dedicated control unit.

With the aid of said electronic control it is possible, among other things, to set the movement of the synchronous motor according to the preferential direction of rotation determined by the impeller blades.

The advantages of the above-described solution consist in its extremely low manufacturing cost and the excellent hydraulic efficiency which can be achieved.

Further characteristic features and advantages of the centrifugal pump according to the present invention will become clear from the description, provided hereinbelow, of a preferred example of embodiment provided by way of a non-limiting example with reference to the accompanying drawings.

DETAILED DESCRIPTION

Figure 1:
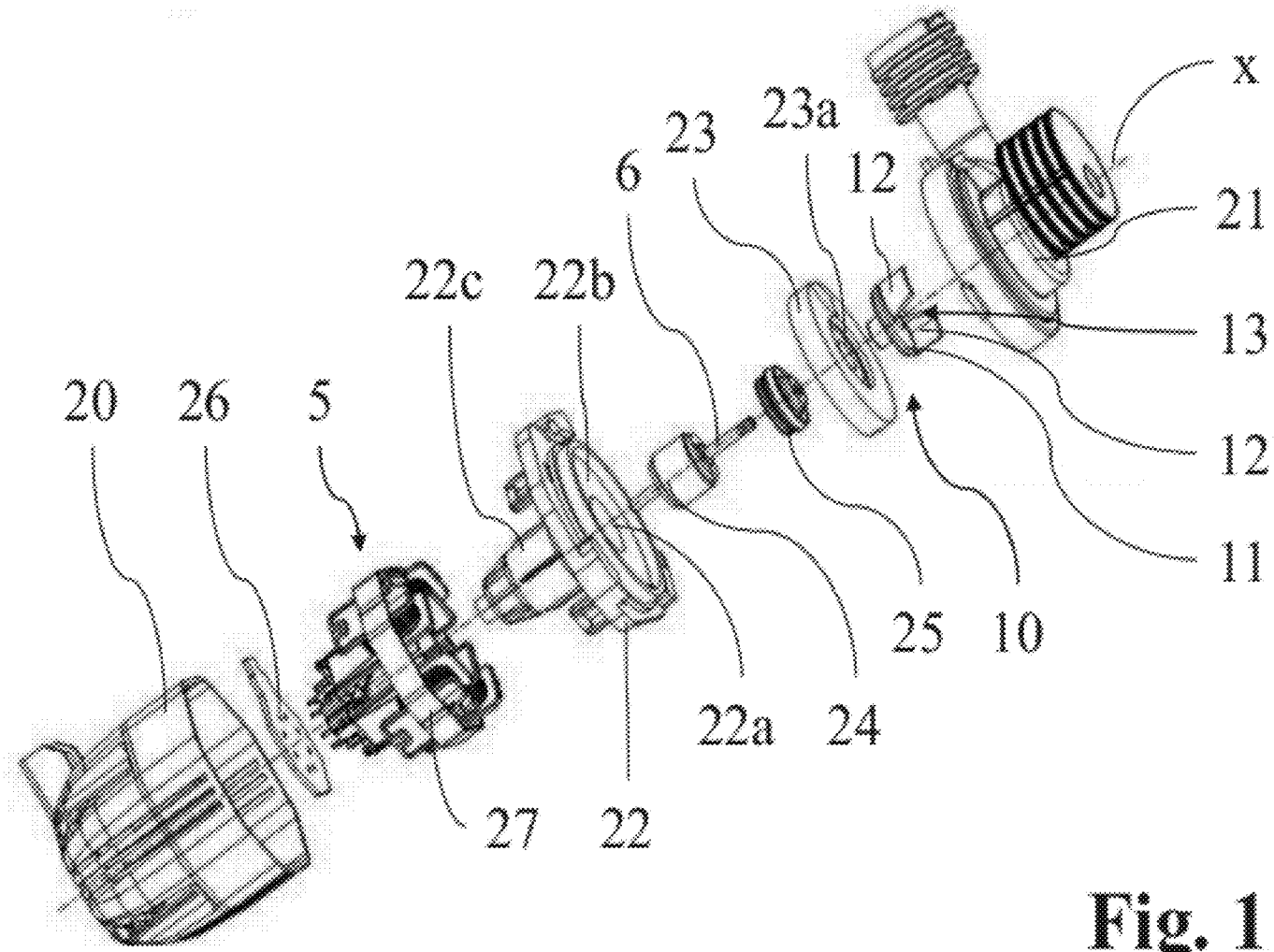
FIG. 1 shows an exploded perspective view of a centrifugal discharge pump assembly according to the present invention.

With reference to the accompanying figures, 1 denotes generically, in its entirety, a centrifugal discharge pump according to the present invention.

As mentioned in the description relating to the field of application, the centrifugal pump 1 is designed specifically for use as a discharge pump inside electric household appliances, in particular domestic or industrial dishwashers. Other uses of the device in related applications, however, are also possible.

The centrifugal pump 1 comprises an intermediate support piece 22 having, associated therewith, on one side a head piece 21 and, on the other side, a box-shaped housing for motor means 5 which will be described below.

On the side where the head piece 21 is located, the intermediate support piece 22 has a cylindrical recess intended to receive a closing plate 23; this cylindrical recess 22*a* has, formed in the centre, a cylindrical seat 22*b* corresponding to a projection 22*c* situated on the opposite side of the intermediate support piece 22.

An assembly formed by a rotor 24, forming part of the motor means 5, and by a transmission shaft 6, integral therewith, is arranged inside the cylindrical seat 22*b*. The two components of the assembly are coaxial and rotatable inside the cylindrical seat 22*b* about a main axis x which forms the axis along which the entire body of the centrifugal pump 1 extends.

The assembly composed of rotor 24 and transmission shaft 6 is kept seated inside the cylindrical seat 22*b* by the closing plate 23 arranged so as to close the said seat; a support disc 25, comprising a bush intended to support the transmission shaft 6, is arranged between the rotor 24 and closing plate 23.

An engaging opening of the head piece 21 is associated perimetrally with the intermediate support piece 21; the aforementioned closing plate 23 is positioned between them. The head piece 21 is internally defined by a flat front inner surface 21*a* connected to the engaging opening by means of a lateral inner surface 21*b* forming a volute. In particular, since the centrifugal pump, as discussed below, is unidirectional, this volute is of the spiral type so as to improve the hydraulic efficiency of the pump.

Figure 3:
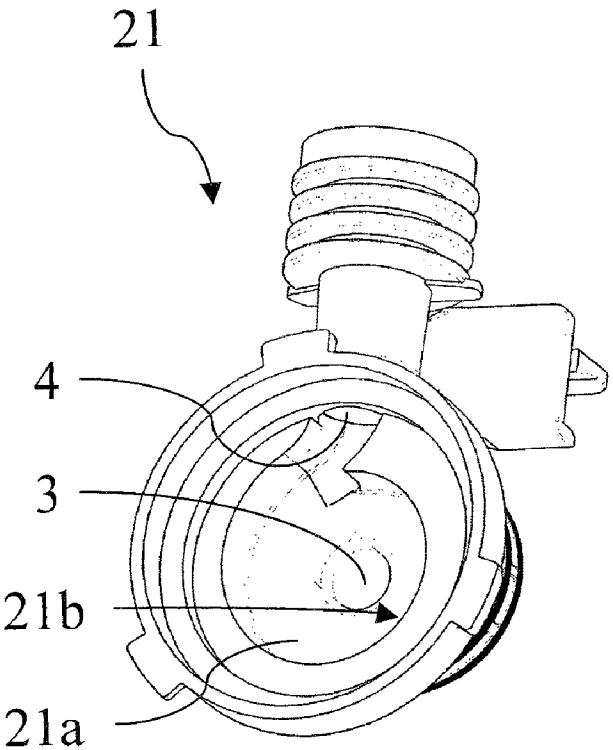
FIG. 3 shows a perspective view of the single element forming the head piece included in the assembly according to FIG. 1.

In other words, the lateral inner surface 21*b* forming the volute has, as is clearly visible in FIG. 3, a radial distance from the main axis x which increases along a circumference travelled in the direction of rotation of the blades 12. The minimum value of this radial distance is situated at the point immediately upstream of the delivery opening 4 and then the distance gradually increases until it reaches a connection with the delivery channel 4*a*.

The inner surfaces 21*a*, 21*b*of the head piece and the closing plate 23 define inside them a working chamber 2 of the centrifugal pump 1 described here.

An intake opening 3 and a delivery opening 4 open out into the working chamber 2. In the example illustrated here the intake opening 3 opens out in the front inner surface 21*a*, coaxial with the previously defined main axis x, while the delivery opening 4 opens out in the lateral inner surface 21*b*.

The two openings—intake opening 3 and delivery opening 4—define the inlet of two straight channels, i.e. intake channel 3*a* and delivery channel 4*a*, respectively, formed in the body of the head piece 21. The intake channel 3*a*, arranged along the main axis x, is designed to convey inside the working chamber 2 a stream of washing liquid to be discharged; the delivery channel 4*a*, which is instead arranged along a radial axis of the head piece, is instead designed to eject the stream of washing liquid from the working chamber 2 into the waste water disposal network suitably connected thereto.

The working chamber 2 houses internally an impeller 10 made of plastic and rotatable about a main axis x so as to move a discharge stream of the electric household appliance originating from the intake channel 3*a* through the delivery channel 4*a*.

The impeller 10 is set in rotation by the previously mentioned motor means 5 by means of the transmission shaft 6 with which it is integral. In the embodiment described here, the impeller 10 has a blind engaging sleeve 14 inside which one end of the transmission shaft 6 is keyed; other engaging means may, however, be used, as will occur to a person skilled in the art. The engaging sleeve 14 and the relevant end of the transmission shaft 6 pass through a receiving hole provided in the centre of the closing plate 23.

The engaging sleeve 14 is associated with one side of the support element 11, while, on the other side, a plurality of blades 12 extend projecting from the said support element 11. Said blades are directed perpendicularly with respect to the disc which forms the support element 11.

In the embodiment described here, the blades 12 are two in number and arranged in a centrally symmetrical manner with respect to the main axis x.

Figure 2:
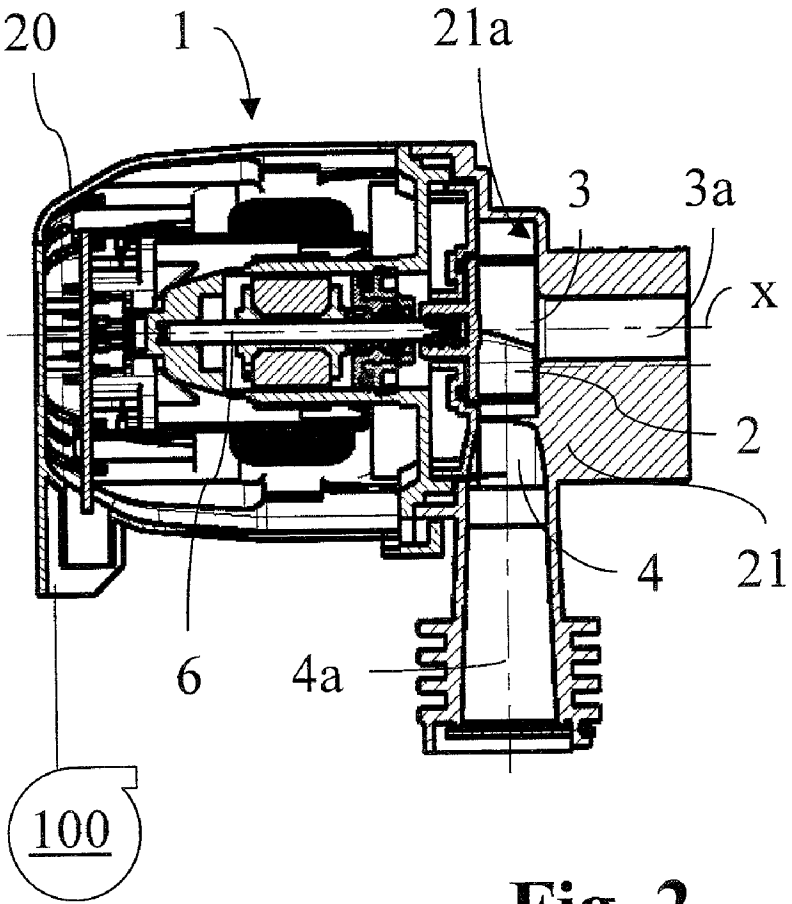
FIG. 2 shows a side view, sectioned along a central plane, of the mounted assembly of the centrifugal discharge pump according to FIG. 1.
Figure 7:
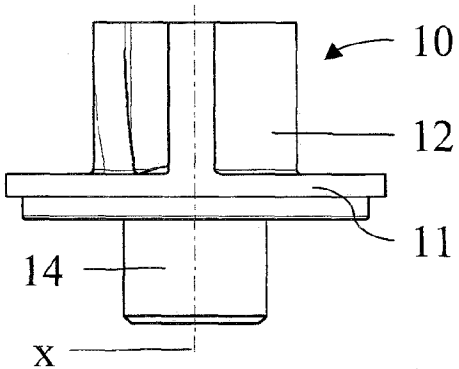
FIG. 7 shows another (non-sectioned) side view of the impeller according to FIG. 5.
Figure 4:
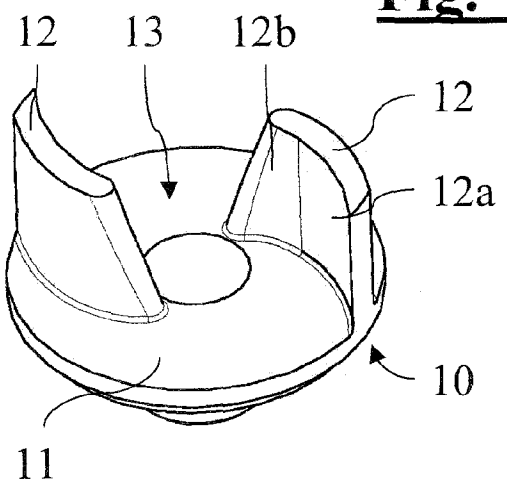
FIG. 4 shows a perspective view of an impeller forming part of the centrifugal pump assembly according to FIG. 1.
Figure 6:
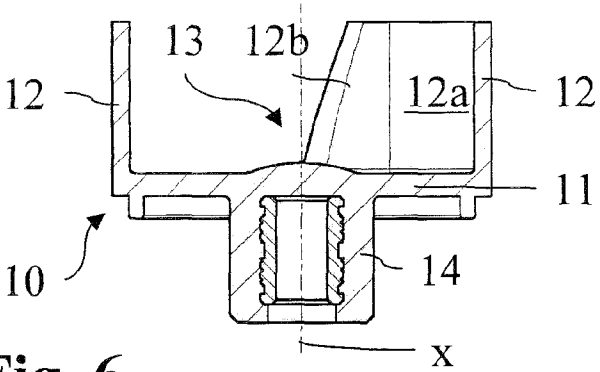
FIG. 6 shows a side view, sectioned along a plane B-B, of the impeller according to FIG. 5.

These blades, as is clearly visible in FIG. 2, extend in a projecting manner from the support element 11 sufficiently far to achieve a close clearance with the front inner surface 21*a*.

Said blades are curved blades which have a convex surface 12*c* and are distinguished by a small uniform thickness, In particular, their convex surface 12*c* faces forwards relative to the direction of rotation of the impeller 10, namely it is precisely said convex surface 12*c* which moves the liquid stream inside the working chamber 2.

Figure 5:
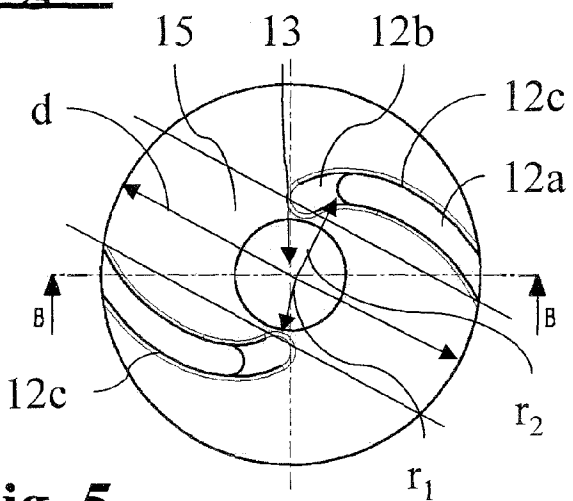
FIG. 5 shows a plan view of the impeller according to FIG. 4.

The curvilinear progression of the blades is clearly visible in the attached FIG. 5. As can be noted, the blades are composed of a first portion 12*a*, which extends from a peripheral edge of the disc forming the support element 11 to an intermediate radius $r_2$ of said disc, and a second portion 12*b*, which extends from the intermediate radius $r_2$ to a radius $r_1$ which is minimal, but more than zero.

The first portion 12*a* has a height—understood as meaning its projection from the disc forming the support element 11—which is constant and such as to achieve a close clearance with the front inner surface 21*a* of the working chamber 2; the second portion 12*b* instead diminishes gradually so as to connect the first portion 12*a* to the disc.

The intake opening 3 has a radius equal to the predefined intermediate radius $r_2$ and the delivery opening also has a radius greater than the minimum radius $r_1$.

As regards the blades 12 of the impeller 10, they are directed so as to leave between them the free space 13 passing diametrically across the disc forming the support element 11. In other words, the free space 13 crosses the impeller along the diameter d of the disc without intersecting either one of the blades 12.

Moreover, the free space 13 passing diametrically across the disc defines a corridor 15 which has a width approximately twice the minimum radius $r_1$ and does not intersect either one of the blades 12.

Essentially, this free corridor 15, which is indicated by broken lines in F*igure* 5 and has a width twice the minimum radius r1, crosses the impeller 10 along a diameter d thereof above the plane defined by the support element 11 without encountering either one of the blades 12. In particular, said corridor 15 comprises a central portion of the impeller 10 through which the main axis x passes. It should be noted that the width of corridor is equal to about one third of the diameter of the disc forming the support element 11.

This corridor 15, or free space 13, is designed to allow removal through the centrifugal pump 1 of any foreign bodies present in the discharge stream.

In this respect, if we consider a solid body with a radius less than twice the minimum radius $r_1$, conveyed by the stream of liquid to be discharged, it will enter into the working chamber through the intake opening 3, arranged opposite the free space 13, and will therefore be situated inside the corridor 15 along which it will be able to travel as far as one of the ends where it then enters into the discharge opening 4, without its movement being hindered by the blades 12.

By way of a guide, it should be noted that in the embodiment shown the minimum radius $r_1$ is slightly greater than 4 mm (the corresponding diameter is equal in this specific case to 8.3 mm); the intermediate radius $r_2$ is instead equal to 6 mm, while the support element 11 has a diameter of 25 mm. By way of comparison, the diameter of the intake opening 3 is instead equal to 10.4 mm.

Another critical dimension is the height of working chamber 2 (understood as the dimension between the support element 11 and the front inner surface 21*a*): the ratio between this dimension and the diameter of the impeller 10 must be less than 1 in order to prevent solid objects with a long shape, such as toothpicks, from entering completely inside the chamber, stopping rotation of the impeller. In this specific case the height in question is in the region of 12 mm.

The motor means 5, contained inside the box-shaped housing 20, in the embodiment described here comprise a synchronous electric motor. Said motor comprises the previously described rotor 24, contained inside the cylindrical recess 22*b*, and a stator 27 arranged around the corresponding projection 22*c*.

The rotor 24 is preferably of the permanent-magnet type, while the stator 27 is connected to a power supply and control board 26. This power supply and control board 26 can be connected to the electronics of a separate washing pump 100 (schematically shown in FIG. 2) of the electric household appliance with which the centrifugal pump 1 is associated; in this way the discharge pump 1 can be controlled by the electronics of the washing pump 100.

Obviously the centrifugal pump described above may be subject to numerous modifications and variations occurring to a person skilled in the art in order to meet specific requirements which may arise, all of these moreover being contained within the scope of protection of the invention as defined by the following claims.

The invention claimed is:

1. A centrifugal discharge pump for electric household appliances, comprising:

a working chamber which has an intake opening and a delivery opening;

an open impeller arranged inside said working chamber and rotatable about a main axis so as to move a discharge stream of the electric household appliance coming from the intake opening through the delivery opening; and motor means designed to drive said impeller by means of a transmission shaft arranged along said main axis, wherein said impeller comprises a support element arranged in a plane perpendicular to the main axis and integral with the transmission shaft, and a plurality of blades projecting from said support element, said impeller having, between said blades, along the main axis, a free space of predefined volume for allowing removal through the centrifugal pump of foreign solids present in the discharge stream, wherein the support element is a disc centered on the main axis, the blades extending along said disc from a peripheral edge of said disc to a minimum radius from the main axis, wherein two blades are provided, the blades directed so that the free space passes diametrically across said disc, without intersecting either one of said blades, and wherein the free space which passes diametrically across the disc forms an unobstructed corridor having a width equal to at least twice the minimum radius.

2. The centrifugal pump according to claim 1, wherein said blades are composed of a first portion, which extends from the peripheral edge of the disc to an intermediate radius and has a constant height relative to the surface of the disc, and a second portion, which extends from the intermediate radius to the minimum radius, with a diminishing height connecting the first portion to the disc surface.

3. The centrifugal pump according to claim 1, wherein the intake opening and the delivery opening have a radius at least equal to the minimum radius.

4. The centrifugal pump according to claim 1, wherein the blades extend projecting from the support element so as to achieve a close clearance with a front inner surface of the working chamber.

5. The centrifugal pump according to claim 1, wherein the impeller is rotatable in a predefined direction of rotation, said blades being curved blades whose convex surface faces forwards relative to said direction of rotation of the impeller.

6. The centrifugal pump according to claim 1, wherein the intake opening opens out in a front inner surface of the working chamber along the main axis and the delivery opening opens out in a lateral inner surface of the working chamber.

7. The centrifugal pump according to claim 1, wherein the motor means comprise a synchronous electric motor which can be controlled by electronics of a separate washing pump of the electric household appliance with which the centrifugal pump is associated.

8. The centrifugal pump according to claim 1, wherein the working chamber is defined laterally by a lateral inner surface forming a spiral volute.

9. The centrifugal pump according to claim 1, wherein the ratio between the height of the working chamber and the diameter of the impeller is less than 1.

* * * * *